United States Patent [19]

Lin

[11] Patent Number: 4,506,248

[45] Date of Patent: Mar. 19, 1985

[54] STACKED AMORPHOUS METAL CORE

[75] Inventor: Kou C. Lin, Hermitage, Pa.

[73] Assignee: Electric Power Research Institute, Inc., Palo Alto, Calif.

[21] Appl. No.: 533,513

[22] Filed: Sep. 19, 1983

[51] Int. Cl.[3] ..... H01F 27/24

[52] U.S. Cl. ..... 336/233; 336/212; 336/213; 336/234

[58] Field of Search ..... 336/212, 213, 215, 219, 336/233, 234

[56] References Cited

U.S. PATENT DOCUMENTS

| | | | |
|---|---|---|---|
| 4,032,874 | 6/1977 | Kudlacik et al. | 336/219 X |
| 4,079,430 | 3/1978 | Fujishima et al. | 336/234 X |
| 4,327,349 | 4/1982 | Ettinger et al. | 336/219 |
| 4,364,020 | 12/1982 | Lin et al. | 336/219 X |

FOREIGN PATENT DOCUMENTS

| | | | |
|---|---|---|---|
| 26871 | 4/1981 | European Pat. Off. . | |
| 2805390 | 8/1979 | Fed. Rep. of Germany | 336/210 |

*Primary Examiner*—A. D. Pellinen
*Assistant Examiner*—Susan Steward
*Attorney, Agent, or Firm*—Flehr, Hohbach, Test, Albritton & Herbert

[57] ABSTRACT

A stacked magnetic core constructed from amorphous strip material. The legs and yokes of the core include first and second laminations formed from a non-amorphous magnetic strip material. The first and second laminations are spaced from one another to define a gap therebetween. A plurality of laminations formed from an amorphous magnetic strip material is stacked in the gap. Means are provided to join the first and second non-amorphous laminations so as to reinforce and support the core.

26 Claims, 9 Drawing Figures

STACKED AMORPHOUS METAL CORE

The present invention relates generally to magnetic cores for use in transformers or like electrical induction apparatus, and more particularly to a construction of a stacked magnetic core made from amorphous metal strip material.

Certain electrical induction apparatus, such as transformers and the like, are provided with a magnetic core constructed with a plurality of stacked layers of laminations. The laminations are formed from a magnetic material to provide a path for magnetic flux. One common way to make such a core is to use magnetic strip material having a preferred direction of orientation parallel to the longitudinal direction of the material, for example, a non-amorphous material such as grain-oriented steel.

Stacked magnetic cores may also be formed from amorphous metal strip material, for example, METGLAS® amorphous metal strip manufactured by the Allied Corporation (METGLAS® is a registered trademark for Allied's amorphous metal alloys). This material has lower core loss characteristics than non-amorphous materials. However, the amorphous strip material is very thin, brittle, and hard. And annealing the material to optimize its magnetic properties further reduces its flexibility.

Extreme care must be exercised when handling amorphous metal strip laminations. Mishandling of the core laminations or the stacked core itself may impair the core's performance and decrease its efficiency. Additionally since the amorphous material is so brittle, it is very difficult to die-punch or drill holes along the laminations to assist in assembling the stacked core.

Studies have shown that amorphous laminations of stacked cores disposed horizontally are subjected to compressive forces which degrade the core loss and exciting power characteristics of the core. The extent of the degradation is a function of the buildup height of the core. The higher the buildup is the greater the decrease in the core's magnetic characteristics. The deleterious effect that compressive forces inflict upon a stacked amorphous core is substantially greater than that experienced with stacked non-amorphous cores made from such materials as high permeability grain oriented silicon iron.

In power transformers, stacked magnetic cores are disposed vertically to facilitate loading of concentric high and low voltage coils. The compressive forces imposed on the amorphous laminations of a vertically positioned core are minimized or eliminated. However, in the vertical position, the flimsy amorphous metal laminations of the core need appropriate support or reinforcement to maintain their rigidity in that position.

Accordingly, an object of the present invention is to provide a stacked amorphous metal core which is rigidly supported in either the vertical or horizontal position.

Another object of the present invention is to provide a stacked amorphous metal core wherein the compressive forces imposed on the core laminations are reduced.

Yet another object of the present invention is to provide a stacked amorphous metal core which may be assembled without forming holes in the amorphous laminations.

The stacked magnetic core of the present invention includes a non-amorphous magnetic strip material forming first and second laminations of a leg or yoke of the core. The first and second laminations of the core leg or yoke are spaced from one another to define a gap therebetween. An amorphous metal strip material forming a plurality of laminations of the leg or yoke are stacked in the gap defined by the first and second non-amorphous laminations. The first and second non-amorphous laminations are joined so that they support each other and the non-amorphous laminations. The compressive forces imposed on the amorphous laminations of the core of the present invention are distributed to the edges of the laminations when the core is in the horizontal position, preventing degradation of the core's magnetic characteristics. In the vertical position, the amorphous laminations of the core of the present invention are rigidly supported.

The core of the present invention will be described in more detail hereinafter in conjunction with the drawings wherein:

FIG. 8 is a perspective view of a three-phase core constructed in accordance with the principles of the present invention.

Figure 1:
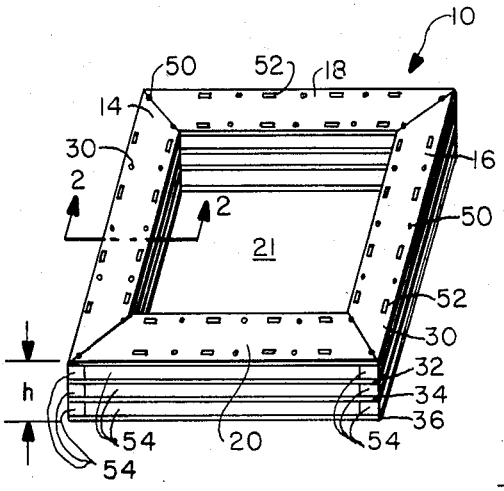
FIG. 1 is a perspective view of a stacked magnetic core constructed in accordance with the present invention.

Referring now to the drawings, in which like components are designated by like reference numerals throughout the various figures, attention is first directed to FIG. 1. FIG. 1 shows a stacked magnetic core, generally indicated by reference numeral 10, constructed in accordance with the present invention. The core is especially suitable for use in a transformer or like electrical induction apparatus. Core 10 may have any appropriate shape, and as illustrated, it may be square. The core includes opposite legs 14 and 16, an upper yoke 18, and a lower yoke 20. The laminations stacked into the core may have different lengths and end cuts to be stacked to form, for example, an I-plate core, a miter cut core, or a step lap core.

Figure 2:
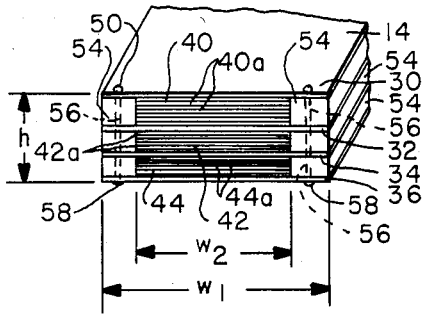
FIG. 2 is a sectional view along lines 2—2 of FIG. 1.

As can be seen from FIGS. 1 and 2, leg 14 of core 10—it being understood that the other leg, and the upper and lower yokes of the core are constructed in a like manner—comprises a number of laminations 30, 32, 34, and 36 formed from a non-amorphous magnetic strip material. Preferably, the non-amorphous magnetic strip material is grain-oriented silicon iron strip. Disposed in the gap or space defined by respective non-amorphous laminations are a group of laminations 40, 42 and 44 formed from an amorphous magnetic strip material, such as one of the METGLAS® amorphous metal alloys referred to previously. Each group of laminations 40–44 comprises a plurality of adjacent laminations 40*a*, 42*a* and 44*a*, respectively.

The amorphous laminations are stacked in the gaps defined by the respective non-amorphous laminations. The particular number of amorphous laminations stacked between respective non-amorphous laminations is dependent upon the core performance required, that is it is a function of the required exciting power and core loss. Non-amorphous laminations 30–36 and amorphous laminations 40–44 may be stacked to any height desired. Core 10 has a height "h". The non-amorphous laminations 30–36 have a width "$w_1$", which is greater than width "$w_2$" of the amorphous laminations 40–44. The difference between the two widths ("$w_1$"–"$w_2$") is approximately equal to the width of rods 54, discussed below.

Figure 3:
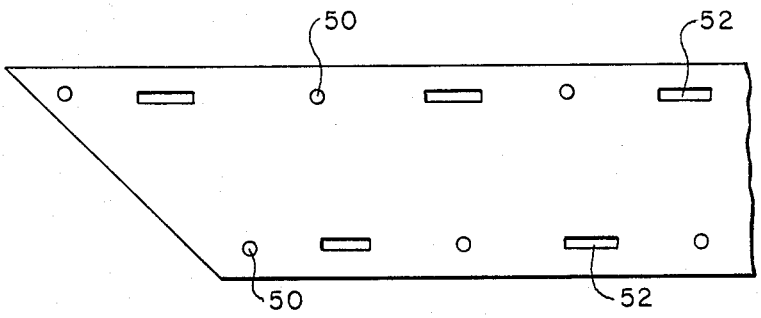
FIG. 3 is a schematic view showing in greater detail a non-amorphous lamination of the core of the present invention.

Each non-amorphous lamination 30–36 will include a plurality of bolt holes 50 and inspection holes 52 (see FIG. 3). The inspection holes 52 are located along both edges of the non-amorphous laminations. The inspection holes facilitate positioning of the amorphous lamination groups 40–44 and rods 54 between the respective non-amorphous laminations. The bolt holes 50 formed in each non-amorphous lamination are provided so that the non-amorphous laminations may be joined together to support the core.

A plurality of rods 54 having a square cross-sectional dimension are provided to support the core laminations. The rods are formed from a dielectric material such as Micarta, Lebonite, or wood. As can be seen from FIG. 2, rods 54 are positioned between respective non-amorphous laminations of the core. The rods are located both about the outer periphery and inner periphery, or core window 21, of the core. The rods and respective non-amorphous laminations form the gaps in which the amorphous laminations are stacked. Bolts 56 are provided to be received in bolt holes 50. The bolts extend into bolt holes 50 and through appropriate holes formed in rods 54 (see FIG. 2). A fastening means, such as nuts 58, are provided to secure bolts 56 within holes 50. Since the non-amorphous laminations overhang the plurality of amorphous laminations, it is not necessary to die-punch to drill holes in the amorphous laminations.

This configuration provides sufficient reinforcement to structurally support the non-amorphous and amorphous laminations of the core, either in the vertical or horizontal positions. The configuration also distributes any compressive forces imposed on the amorphous laminations to the edges of the laminations, thereby minimizing the undesirable effect that compressive forces have on the core's loss and exciting power characteristics.

Figure 4:
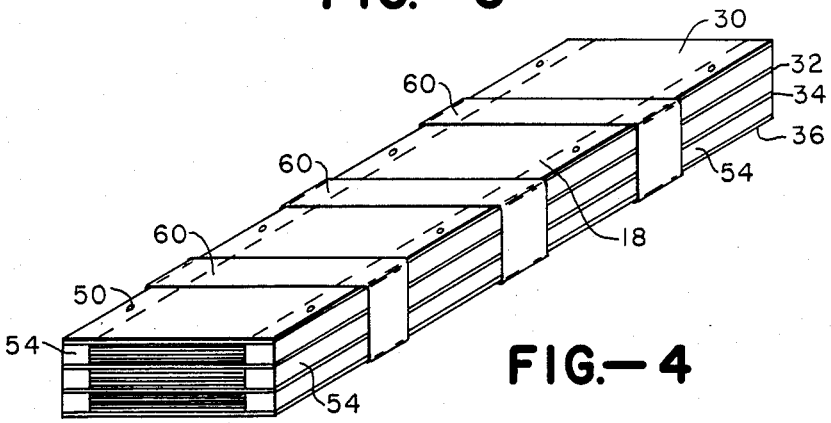
FIG. 4 is a schematic view illustrating a yoke of the core of the present invention and a means for binding the laminations forming the yoke.

As shown in FIG. 4, core 10 may also be provided with additional means for securing the non-amorphous and amorphous laminations. FIG. 4 shows yoke 18 including a plurality of core bands 60 looped about the yoke and fastened thereto to hold the non-amorphous and amorphous laminations in position. Of course, core bands 60 may also be used to fasten the laminations of yoke 20, and legs 14 and 16.

Figure 5:
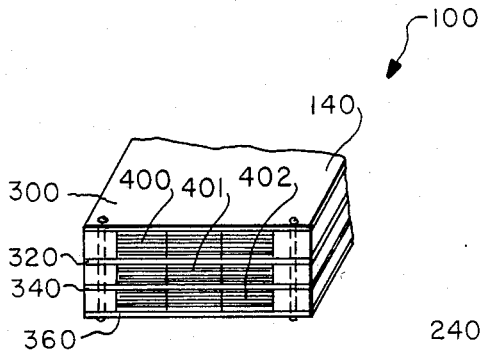
FIG. 5 is a sectional view of an alternate embodiment of the core of the present invention.

A number of possible variations of a stacked magnetic core constructed in accordance with the present invention are possible. For instance, core 10 may simply comprise one upper and one lower non-amorphous laminations with a plurality of amorphous laminations stacked therebetween. Yet another variation is shown in FIG. 5 which illustrates a sectional view of a core leg 140 of a core 100 wherein the gaps defined by respective non-amorphous laminations 300, 320, 340, and 360 are stacked with multiple groups of amorphous laminations. As shown, amorphous lamination groups 400, 401, and 402, each made up of a plurality of amorphous laminations, are stacked within the gap defined by non-amorphous laminations 300 and 320. Likewise, the gaps defined by non-amorphous laminations 320, 340, and 360 are stacked with multiple groups of amorphous laminations.

Figure 6:
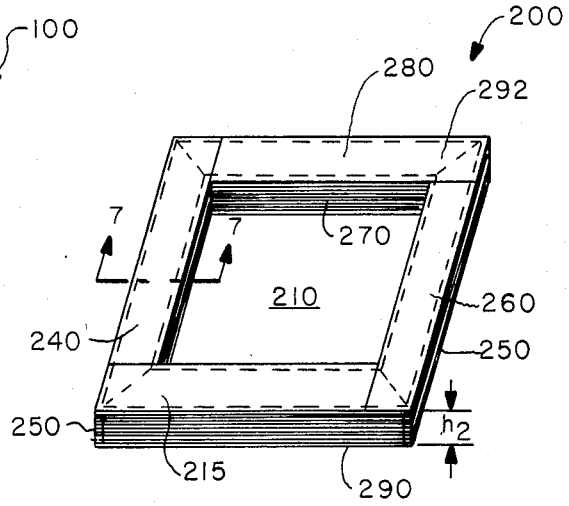
FIG. 6 is a perspective view illustrating another embodiment of the core of the present invention.
Figure 7:
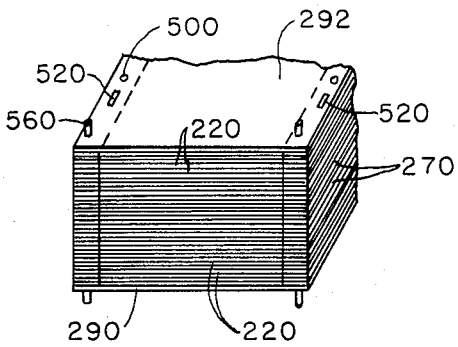
FIG. 7 is a sectional view along the lines 7—7 of FIG. 6.

Another embodiment of the present invention is shown in FIGS. 6 and 7. FIG. 6 shows a stacked magnetic core 200 having legs 260 and 240, an upper yoke 280, and a lower yoke 215. Core 200 as illustrated is an I-plate core. The legs and yokes of core 200 (see FIG. 7) comprise a plurality of laminations 220 formed from an amorphous magnetic strip material such as the METGLAS® alloys referred to above. Amorphous laminations 220 are stacked so that core 200 has a height "$h_2$". Positioned about the outer edge of amorphous laminations 220 and around the entire periphery of the legs and yokes of the core are strips 250. Strips 250 are formed from a non-amorphous magnetic strip material and are stacked to a height "$h_2$". Similarly positioned about the inner edges of amorphous laminations 220 about the periphery of core window 210 is a second group of strips 270 of non-amorphous strip material. Strips 270 are also stacked to a height "$h_2$". Preferably, the non-amorphous strips 250 and 270 are formed from HIPERSIL® material (a Westinghouse Electric Corporation registered trademark).

Additionally, and similar to the embodiment of FIGS. 1–3, core 200 also includes non-amorphous lamination 290 positioned beneath amorphous laminations 220. A second non-amorphous lamination 292 is positioned above amorphous laminations 220. The width of non-amorphous laminations 290 and 292 is approximately equal to the combined widths of amorphous laminations 220, and non-amorphous strips 250 and 270. Appropriate bolt holes 500 are formed in non-amorphous laminations 290 and 292. The bolt holes in laminations 290 and 292 are formed so that they may be aligned with corresponding bolt holes in non-amorphous strips 250 and 270. A bolt 560 is inserted in the holes in the non-amorphous laminations and strips and secured so that the entire structure of the core is supported by means of the non-amorphous strips and laminations. Inspection slots 520 are also provided.

Figure 8:
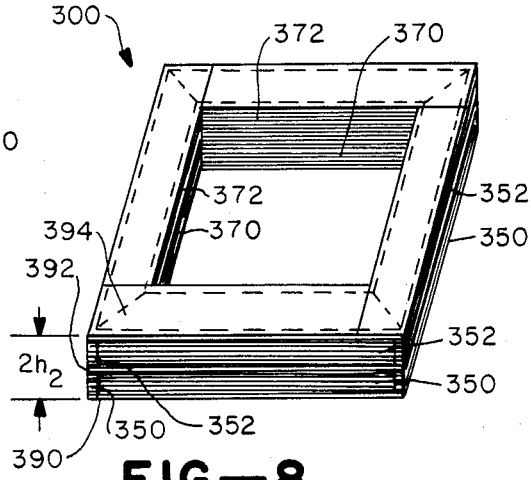
FIG. 8 is a perspective view illustrating yet another embodiment of the present invention.

FIG. 8 illustrates a variation of the embodiment of FIGS. 6 and 7. Core 300 of FIG. 8 has a height of approximately "$2h_2$", and comprises amorphous laminations (not shown) stacked between respective non-amorphous laminations 390, 392, and 394. As in the embodiments of FIGS. 6 and 7, core 300 includes appropriate groups of non-amorphous strips 350 and 352, and 370 and 372 located about the outer and inner peripheries, respectively, of the core's legs and yokes. The embodiments of FIGS. 6–7 and 8, like the embodiment of FIG. 1, provides a stacked amorphous metal core which is mechanically rigid wherein the compressive forces imposed on the amorphous laminations of the core are minimized. This embodiment also permits the core to be constructed without die-punching or drilling holes in the amorphous laminations.

Figure 9:
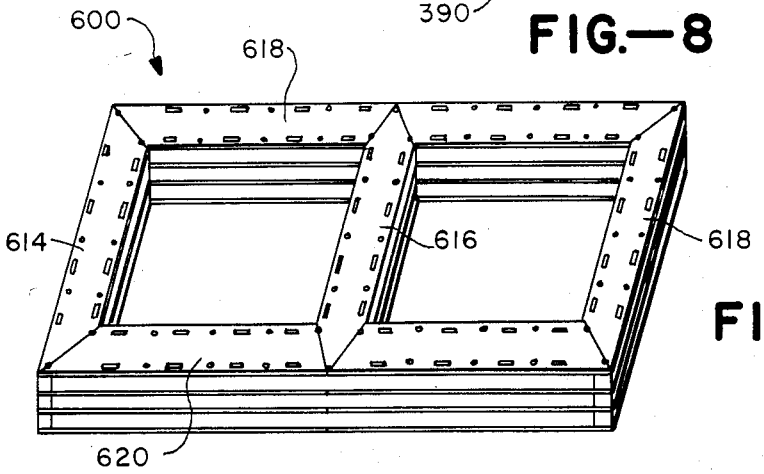

The embodiments of the present invention discussed heretofore have been directed to single-phase transformer cores. The teachings of the present invention, however, may also be applied to three-phase transformer cores. For instance, a three-phase transformer core 600 (See FIG. 9) having upper and lower yokes 618 and 620, respectively, and legs 614, 616 and 619 may be constructed in a manner like that of the embodiment of FIGS. 1–4. Similarly, a three-phase transformer core could be constructed in a manner similar to that of the embodiments of FIGS. 6–7 and 8.

Although certain specific embodiments of the invention have been described herein in detail, the invention is not to be limited to only such embodiments, but rather only by the appendant claims.

What is claimed is:

1. A stacked magnetic core for an electrical induction apparatus, comprising:

a non-amorphous magnetic strip material forming a first lamination of a leg or yoke of said core;

a non-amorphous magnetic strip material forming a second lamination of said leg or yoke and spaced from said first lamination to define a gap therebetween;

an amorphous magnetic strip material forming a plurality of laminations of said leg or yoke and stacked in said gap defined by said first and second non-amorphous laminations, the width of said amorphous laminations being less than that of said non-amorphous laminations; and means joining said first and second non-amorphous laminations to support said non-amorphous and amorphous laminations of said core.

2. The stacked magnetic core of claim 1 wherein said support means comprises a plurality of dielectric members positioned in said gap adjacent to said amorphous laminations about the inner and outer peripheries of said core.

3. The stacked magnetic core of claim 2 wherein said dielectric members are rod-like in shape and have a square cross-sectional dimension.

4. The stacked magnetic core of claim 3 further including openings formed in said first and second non-amorphous laminations for securing said non-amorphous laminations to said rod-like members.

5. The stacked magnetic core of claim 4 wherein said first and second non-amorphous laminations have inspection slots formed therein to facilitate positioning of said amorphous laminations in said gap formed between said first and second non-amorphous laminations.

6. The stacked magnetic core of claims 2 or 5 further including band means looped about said non-amorphous and amorphous laminations forming said leg or yoke for securing said laminations.

7. The stacked magnetic core of claim 1 wherein said non-amorphous laminations are grain oriented silicon iron strip.

8. The stacked magnetic core of claim 1 wherein said first and second non-amorphous laminations and said amorphous laminations stacked therebetween from a first group of laminations with said leg or yoke of said core comprising a plurality of said groups joined to one another.

9. A stacked magnetic core for an electrical induction apparatus, comprising:

a first lamination of a leg or yoke of said core formed from a non-amorphous magnetic strip material;

a second lamination of said leg or yoke formed from a non-amorphous magnetic strip material positioned above and spaced from said first lamination to define a gap therebetween;

a first plurality of laminations formed from an amorphous magnetic strip material and stacked in said gap defined by said first and second non-amorphous laminations so as to minimize compressive forces imposed on said amorphous laminations, the width of said amorphous laminations being less than that of said first and second non-amorphous laminations; and means joining said first and second laminations to support said non-amorphous and amorphous laminations forming said leg or yoke of said core.

10. A stacked magnetic core for an electrical induction apparatus, comprising:

a first lamination of a leg or yoke of said core formed from a non-amorphous magnetic strip material;

a second lamination of said leg or yoke formed from a non-amorphous magnetic strip material positioned above and spaced from said first lamination to define a gap therebetween;

a first plurality of laminations formed from an amorphous magnetic strip material and stacked in said gap defined by said first and second non-amorphous laminations, the width of said amorphous laminations being less than that of said first and second non-amorphous laminations;

a first dielectric member positioned in said gap adjacent to and along the outer edge of said amorphous laminations of said leg or yoke;

a second dielectric member positioned in said gap adjacent to and along the inner edge of said amorphous laminations of said leg or yoke; and a means joining said non-amorphous laminations and said first and second dielectric members to support said laminations of said core.

11. The stacked magnetic core of claim 10 wherein said dielectric members are rod-like in shape and have a square cross-sectional dimension.

12. The stacked magnetic core of claim 11 wherein said joining means includes openings formed in said first and second non-amorphous laminations for securing said non-amorphous laminations to said rod-like members.

13. The stacked magnetic core of claim 12 wherein said first and second non-amorphous laminations have inspection slots formed therein to facilitate positioning of said amorphous laminations and said rod-like members in said gap formed between said first and second non-amorphous laminations.

14. The stacked magnetic core of claim 13 further including band means looped about said non-amorphous and amorphous laminations forming said leg or yoke for securing said laminations.

15. The stacked magnetic core of claim 10 wherein said first and second non-amorphous laminations and said amorphous laminations stacked therebetween from a first group of laminations with said legs or yokes of said core comprising a plurality of said groups joined to one another.

16. A stacked magnetic core for an electrical induction apparatus, comprising:

a plurality of laminations formed from an amorphous magnetic material stacked to form legs and yokes of said core;

a first group of strips of non-amorphous magnetic material stacked along the outer edge of said plurality of amorphous laminations and about the outer periphery of said legs and yokes;

a second group of strips of non-amorphous magnetic material stacked along the inner edge of said plurality of amorphous laminations and about the inner periphery of said legs and yokes;

first means fixedly joining said non-amorphous strips of said first group; and second means fixedly joining said non-amorphous strips of said second group.

17. The stacked magnetic core of claim 16 wherein said non-amorphous magnetic material is a grain oriented silicon steel material.

18. The stacked magnetic core of claim 16 wherein said first and second groups of strips of non-amorphous magnetic material is stacked to a height equal to that of said plurality of amorphous laminations.

19. A stacked magnetic core for an electrical induction apparatus, comprising:

a plurality of laminations formed from an amorphous magnetic material stacked to form legs and yokes of said core;

a first group of strips of non-amorphous magnetic material stacked along the outer edge of said plurality of amorphous laminations and about the outer periphery of said legs and yokes;

a second group of strips of non-amorphous magnetic material stacked along the inner edge of said plurality of amorphous laminations and about the inner periphery of said legs and yokes;

a first lamination of said legs or yokes formed from a non-amorphous magnetic strip material positioned adjacent to and beneath said plurality of amorphous laminations and said first and second groups of non-amorphous strips;

a second lamination of said legs or yokes formed from a non-amorphous magnetic strip material positioned adjacent to and above said plurality of amorphous laminations and said first and second groups of non-amorphous strips, the width of said first and second non-amorphous laminations being greater than that of said amorphous laminations; and means joining said first and second non-amorphous laminations and said first and second groups of non-amorphous strips to support said laminations of said core.

20. The stacked magnetic core of claim 19 wherein said first and second groups of non-amorphous strips are stacked to a height equal to that of said plurality of amorphous laminations.

21. The stacked magnetic core of claim 20 wherein said non-amorphous laminations have openings formed therein for securing said non-amorphous laminations to said first and second groups of non-amorphous strips.

22. The stacked magnetic core of claim 21 wherein said non-amorphous laminations have inspection slots formed therein to facilitate positioning of said first and second groups of non-amorphous strips and said amorphous laminations.

23. The stacked magnetic core of claims 19 or 22 wherein said first and second groups of nonamorphous strips, and said first and second non-amorphous laminations are formed from grain oriented silicon steel.

24. The stacked magnetic core of claim 19 wherein said first and second non-amorphous laminations, said amorphous laminations, and said first and second groups of non-amorphous strips form a first section of laminations of said legs and yokes with said legs and yokes comprising a plurality of said sections joined to one another.

25. A method of fabricating a stacked magnetic core of an electrical induction apparatus, comprising:

forming a first lamination of a leg or yoke of said core from a non-amorphous magnetic strip material;

forming a second lamination of said leg or yoke from a non-amorphous magnetic strip material and spacing said second lamination from said first lamination to define a gap therebetween;

forming a plurality of laminations of said leg or yoke from an amorphous magnetic strip material and stacking said amorphous laminations in said gap defined by said first and second non-amorphous laminations;

positioning a first dielectric member in said gap adjacent to and along the outer edge of said amorphous laminations of said leg or yoke;

positioning a second dielectric member in said gap adjacent to and along the inner edge of said amorphous laminations of said leg or yoke; and joining said non-amorphous laminations and said first and second dielectric members to support said laminations of said core.

26. A method of fabricating a magnetic core of an electrical induction apparatus, comprising:

stacking a plurality of laminations formed from an amorphous magnetic material to form legs and yokes of said core;

positioning a first group of strips of non-amorphous magnetic material along the outer edge of said plurality of amorphous laminations about the outer periphery of said legs and yokes;

positioning a second group of strips of non-amorphous magnetic material along the inner edge of said plurality of amorphous laminations about the inner periphery of said legs and yokes;

forming a first lamination of said legs or yokes from a non-amorphous magnetic strip material and locating said first lamination adjacent to and beneath said plurality of amorphous laminations and said first and second groups of non-amorphous strips;

forming a second lamination of said legs or yokes from a non-amorphous magnetic strip material and locating said second lamination adjacent to and above said plurality of amorphous laminations and said first and second groups of non-amorphous strips; and joining said first and second non-amorphous laminations and said first and second groups of non-amorphous strips to support said laminations of said core.

* * * * *

UNITED STATES PATENT AND TRADEMARK OFFICE

CERTIFICATE OF CORRECTION

PATENT NO. : 4,506,248

DATED : March 19, 1985

INVENTOR(S) : Kou C. Lin

It is certified that error appears in the above-identified patent and that said Letters Patent are hereby corrected as shown below:

At Column 2, line 40, the numeral "8" should be --9--.

Signed and Sealed this

*First* Day of *October 1985*

[SEAL]

*Attest:*

*Attesting Officer*

DONALD J. QUIGG

*Commissioner of Patents and Trademarks—Designate*